US007900784B1

(12) United States Patent
Weigand et al.

(10) Patent No.: US 7,900,784 B1
(45) Date of Patent: Mar. 8, 2011

(54) CONFIGURABLE RETAIL DISPLAYS

(75) Inventors: Christopher P. Weigand, Sagamore Hills, OH (US); Andrew James Gallo, North Ridgeville, OH (US)

(73) Assignee: American Greetings Corporation, Cleveland, OH (US)

( * ) Notice: Subject to any disclaimer, the term of this patent is extended or adjusted under 35 U.S.C. 154(b) by 365 days.

(21) Appl. No.: 11/955,691

(22) Filed: Dec. 13, 2007

Related U.S. Application Data

(63) Continuation-in-part of application No. 29/284,506, filed on Sep. 10, 2007, now Pat. No. Des. 584,078.

(51) Int. Cl.
*A47B 43/00* (2006.01)

(52) U.S. Cl. ..... 211/186; 211/55

(58) Field of Classification Search ..... 211/52, 211/55, 186, 204, 206, 106, 187; 108/92, 108/180, 181
See application file for complete search history.

(56) References Cited

U.S. PATENT DOCUMENTS

| | | | | | |
|---|---|---|---|---|---|
| 1,311,975 | A * | 8/1919 | Kroff | 211/55 |
| 2,002,128 | A * | 5/1935 | Reidenbaugh | 211/1 |
| 2,087,421 | A * | 7/1937 | Williams | 211/128.1 |
| 2,798,617 | A * | 7/1957 | Schreiber | 108/32 |
| 2,802,576 | A * | 8/1957 | Kelling | 211/59.1 |
| 3,173,386 | A * | 3/1965 | Magers | 108/108 |
| 3,276,400 | A * | 10/1966 | Brunette | 108/181 |
| 3,537,596 | A * | 11/1970 | Brunette | 211/186 |
| 3,777,897 | A * | 12/1973 | Gray | 211/55 |
| 3,908,830 | A * | 9/1975 | Skrzelowski | 211/55 |
| 4,197,950 | A * | 4/1980 | Ovitz, III | 211/134 |
| 4,299,327 | A * | 11/1981 | Thauer | 211/186 |
| 4,359,947 | A * | 11/1982 | Marschak | 108/1 |
| 4,903,847 | A * | 2/1990 | Duffy | 211/187 |
| 5,014,859 | A * | 5/1991 | Johnson | 211/55 |
| 5,029,715 | A * | 7/1991 | Strada | 211/55 |
| 5,201,191 | A * | 4/1993 | Bustos | 62/249 |
| 5,295,446 | A * | 3/1994 | Schafer | 108/167 |
| 5,718,441 | A * | 2/1998 | Kern et al. | 280/79.3 |
| 5,915,571 | A * | 6/1999 | Czalkiewicz et al. | 211/55 |
| 6,116,436 | A * | 9/2000 | Ferrucci et al. | 211/187 |
| 6,170,674 | B1 * | 1/2001 | Caterinacci | 211/41.1 |
| 6,196,401 | B1 * | 3/2001 | Brady et al. | 211/186 |
| 6,427,853 | B2 * | 8/2002 | Brozak, Jr. | 211/55 |
| 6,607,083 | B1 * | 8/2003 | Webb | 211/59.2 |
| 6,659,294 | B1 * | 12/2003 | Simard | 211/181.1 |
| 6,729,484 | B2 * | 5/2004 | Sparkowski | 211/187 |
| 6,783,012 | B2 * | 8/2004 | Webb | 211/59.2 |
| 6,955,268 | B2 * | 10/2005 | Waldron | 211/51 |

(Continued)

*Primary Examiner* — Jennifer E. Novosad
(74) *Attorney, Agent, or Firm* — Roetzel & Andress

(57) ABSTRACT

Product displays which are easily and extensively configurable with respect to the number and arrangement of product supporting display units with shelves, the display units having a display frame with multiple levels for supporting a plurality of display units. Each display unit includes one or more product supporting shelves. The display units may be one-sided, with right triangle frames having shelves which face one side of the display, or two-sided with A-shaped frames and shelves on opposing sides of the A-shaped frames to face opposite sides of the display. The shelves of the display units on opposing sides of the display may be symmetrical in number and size or asymmetrical. The display units are easily installed and removed from the various levels of the display frame in order that the display may be easily configured and re-configured according to a desired retail and product presentation. Vertical panels are disposed between opposing shelves of the display units.

26 Claims, 5 Drawing Sheets

U.S. PATENT DOCUMENTS

| | | | | |
|---|---|---|---|---|
| 7,097,049 | B1 * | 8/2006 | Singer et al. | 211/55 |
| D584,078 | S * | 1/2009 | Weigand | D6/473 |
| 2001/0025823 | A1 * | 10/2001 | Brozak | 211/55 |
| 2003/0196972 | A1 * | 10/2003 | Webb | 211/59.2 |
| 2004/0035810 | A1 * | 2/2004 | Eustace | 211/162 |
| 2004/0140276 | A1 * | 7/2004 | Waldron | 211/51 |
| 2004/0256341 | A1 * | 12/2004 | Donnell et al. | 211/187 |
| 2005/0092699 | A1 * | 5/2005 | Stravitz | 211/11 |
| 2005/0139561 | A1 * | 6/2005 | Ohkubo | 211/128.1 |
| 2005/0230338 | A1 * | 10/2005 | Farinola et al. | 211/186 |

* cited by examiner

CONFIGURABLE RETAIL DISPLAYS

RELATED APPLICATION

This application is a continuation-in-part and claims priority to U.S. design patent application Ser. No. 29/284,506 filed Sep. 10, 2007 now U.S. Pat. No. D,584,078.

FIELD OF THE INVENTION

The invention is in the general field of retail displays and merchandising systems, and more particularly displays and merchandising systems for paper and printed products including greeting cards.

BACKGROUND OF THE INVENTION

Greeting card displays as used in retail stores have been made in many forms, generally designed to neatly present a large number and variety of cards in a dense but attractive arrangement. Common features of such displays are successive rows of card shelves, tiered or vertical, with dividers on each shelf to define multiple card pockets. The shelves are attached to and supported by a back panel which is supported upon a vertically oriented frame, sometimes referred to as a "gondola". The frame or frames may include spaced-apart upright members with multiple attachment points, with other structural members attached to span between the upright members. In some greeting card displays, the shelves and pocket dividers may be rigidly attached to a back panel supported by the gondola frame by fasteners, so that any assembly or adjustment of the display requires removal and re-attachment of such fasteners. Also, the spacing of the shelves and dividers is constant, so that there is little or no flexibility to accommodate cards of different sizes in the same display, or to change the number of card pockets on any given shelf.

Some displays use a single piece back panel on which the rows or tiers of shelves are formed. In such tiered displays, the back panel is typically manufactured as a single piece in which multiple tiers are molded to form rows of card pockets. The vertical spacing of the rows is thus fixed with no provision for adjustment to accommodate cards of different sizes or to alter the card product mix of the display. Although displays of this type are economical to manufacture due to fewer required parts, flexibility is sacrificed, and the display appearance is standardized and generic.

Welded wire form products, such as shopping carts and other types of containers, provide substantial strength and open structures with high visibility through the structures. This type of construction has been adapted to various retail displays, including greeting card and related product displays. Exposed steel framing is used to support open welded wire assemblies which form tiered display shelves. The use of heavy gauge material and permanent welds severely limits display flexibility.

SUMMARY OF THE INVENTION

The present disclosure is of product displays, including retail product displays which are easily and extensively configurable and reconfigurable with respect to the number and arrangement of product supporting display units and shelves. A display frame has multiple levels for supporting a plurality of display units. Each display unit includes one or more product supporting shelves. The display units may be one-sided, having shelves which face one side of the display, or two-sided with shelves on opposing sides of the display. The shelves on opposing sides of the display may be symmetrical in number and size or asymmetrical. The display units are easily installed and removed from the various levels of the display frame in order that the display may be easily configured and re-configured according to a desired retail presentation.

DETAILED DESCRIPTION OF PREFERRED AND ALTERNATE EMBODIMENTS

Figure 6:
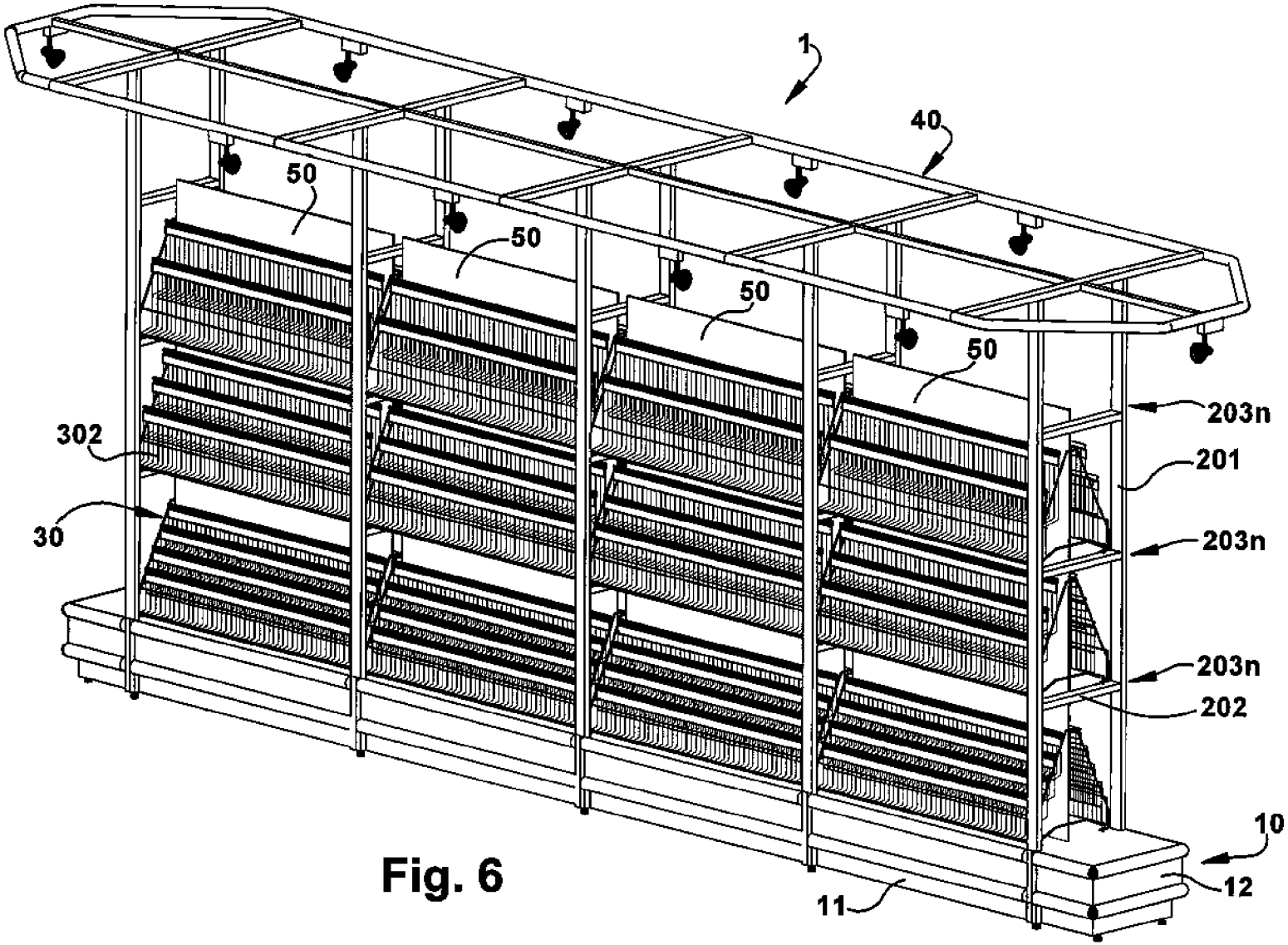
FIG. 6 is a perspective view of an alternate embodiment of a configurable retail display of the disclosure.

As shown in the Figures, a display of the disclosure, indicated in its entirety at 1, has in general a base 10, a support frame 20, multiple display units 30, and an overhead frame 40. The base 10 is in one form generally rectangular, with a longitudinal side 11 and ends 12 which span and define a width of the display. The base 10 serves as an elevating platform for the entire display and defines the display footprint for retail installation, such as a stand-alone display or to be arranged in series along a store aisle as shown in FIG. 6. The base 10 may be constructed in any form which supports or otherwise provides a foundation for the support frame 20 as further described.

Figure 1:
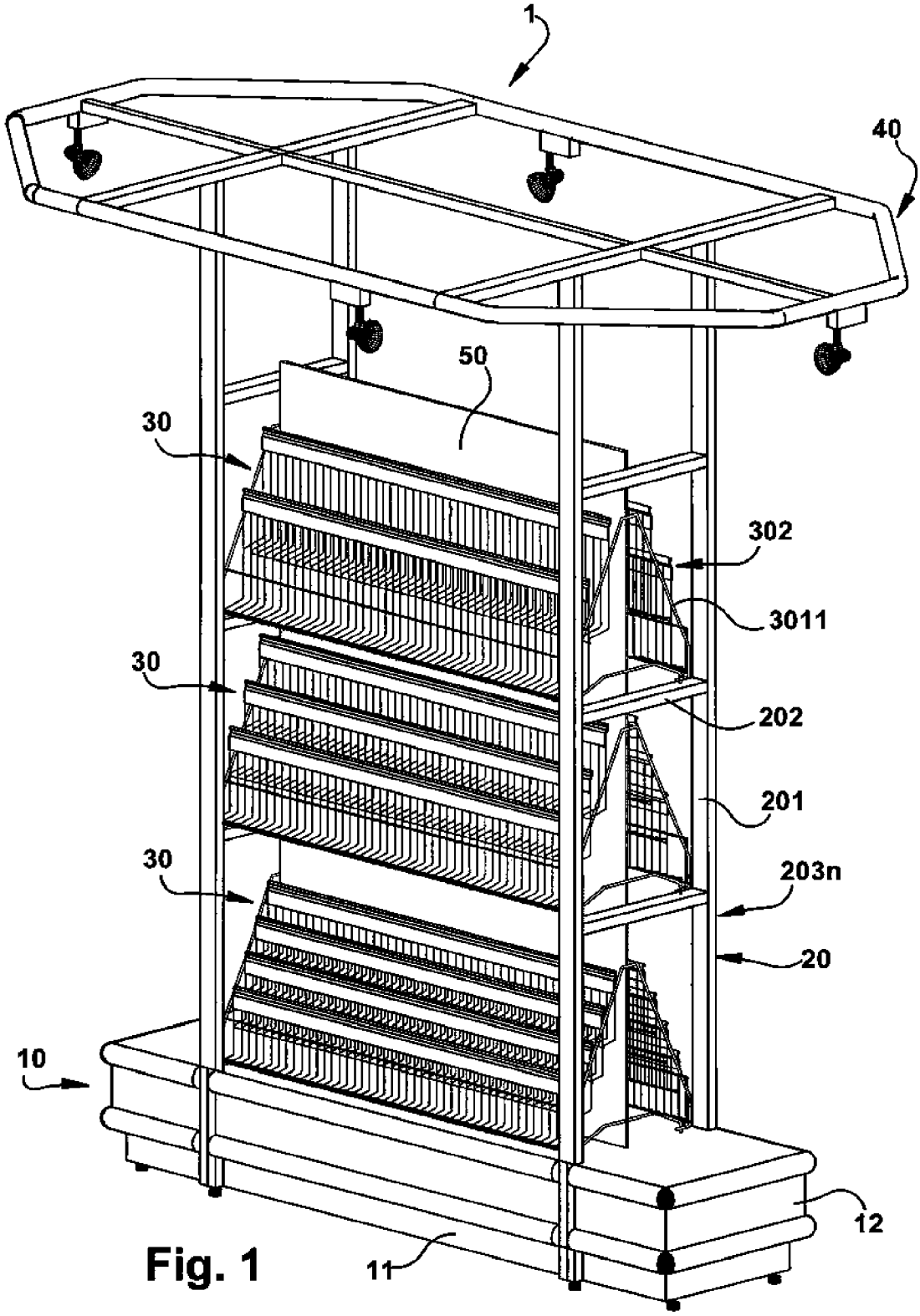
FIG. 1 is a perspective view of a representative embodiment of a configurable retail display of the disclosure.

The support frame 20 includes vertical members 201 arranged in opposing pairs across the width of the base and connected by cross beams 202. As shown in FIG. 1, two pairs of vertical members 201 are spaced apart along the longitudinal side 11 of the base to define a width dimension of one module of the display, as further described. The vertical members 201 also extend upward from the base 10 to generally define the vertical extent and height of the display. The general configuration of the support frame 20 may be in different forms which define the height, width and overall size of the display modules, and the cross-sectional shape of the vertical members 201 and cross beams 202 may be varied in size or form.

Figure 2:
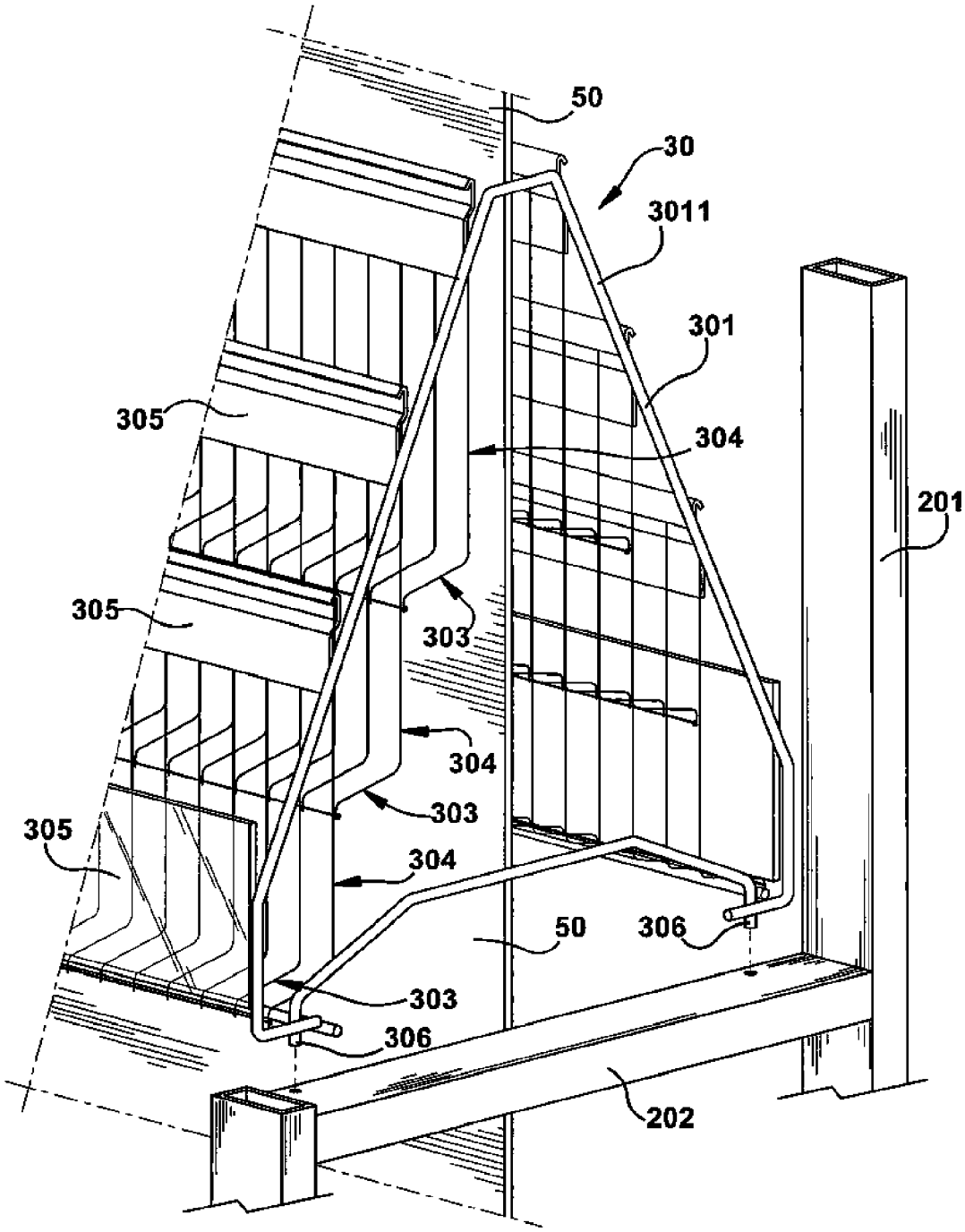
FIG. 2 is perspective partial assembly view of a portion of a configurable retail display of the disclosure.

The pairs of cross beams 202 located at different heights along the length of the vertical members 201 form a rack structure with different levels or elevations 203*n* of the support frame, each of which supports one or more display units, generally indicated at 30. Each display unit 30 has a display unit frame 301 located at opposing ends and one or more shelves 302 which span between the display unit frames 301. Each of the shelves 302 are configured to have a product supporting plane or surface 303, a back wall 304 which extends upward from the plane 303 and a front wall 305 which also extends upward from the product supporting plane 303, generally parallel to and spaced from the back wall 304. When arranged in tiers as shown, an upper portion of a back wall 304 of one of the shelves 302 may serve as the front wall 305 of the next higher successive shelf 302. As shown in FIG. 2, the product support plane 303 of a next higher successive shelf 302 may intersect a back wall 304 of the adjacent lower shelf 302 to form a tiered shelf arrangement.

Figure 3:
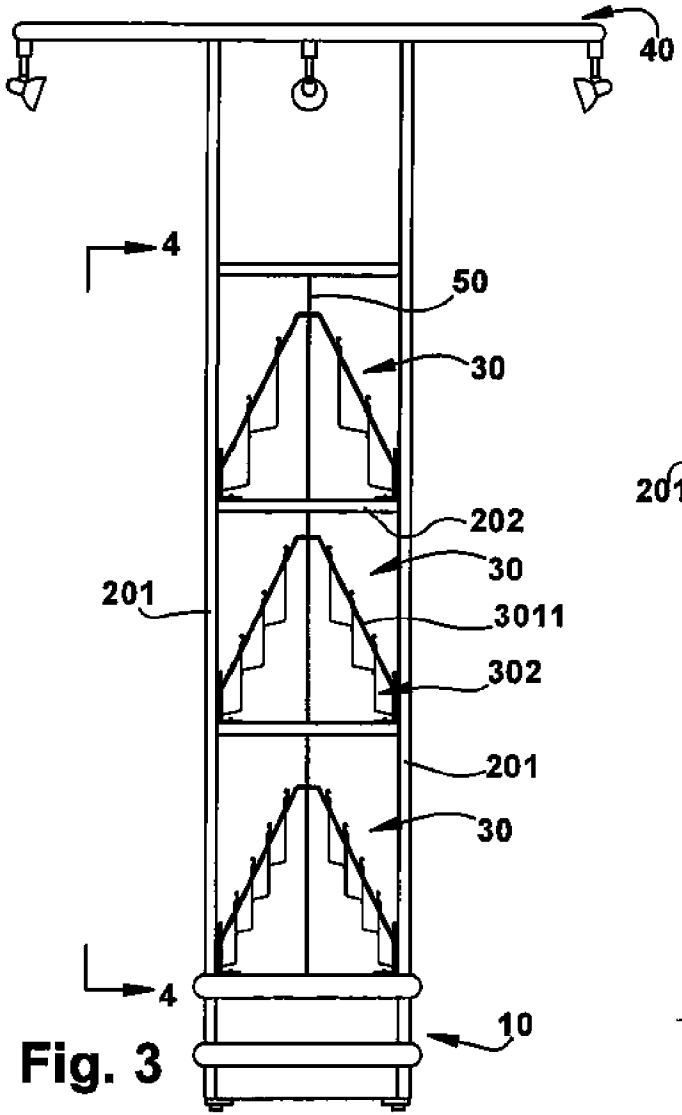
FIG. 3 is an end view of the configurable retail display shown in FIG. 1.
Figure 5:
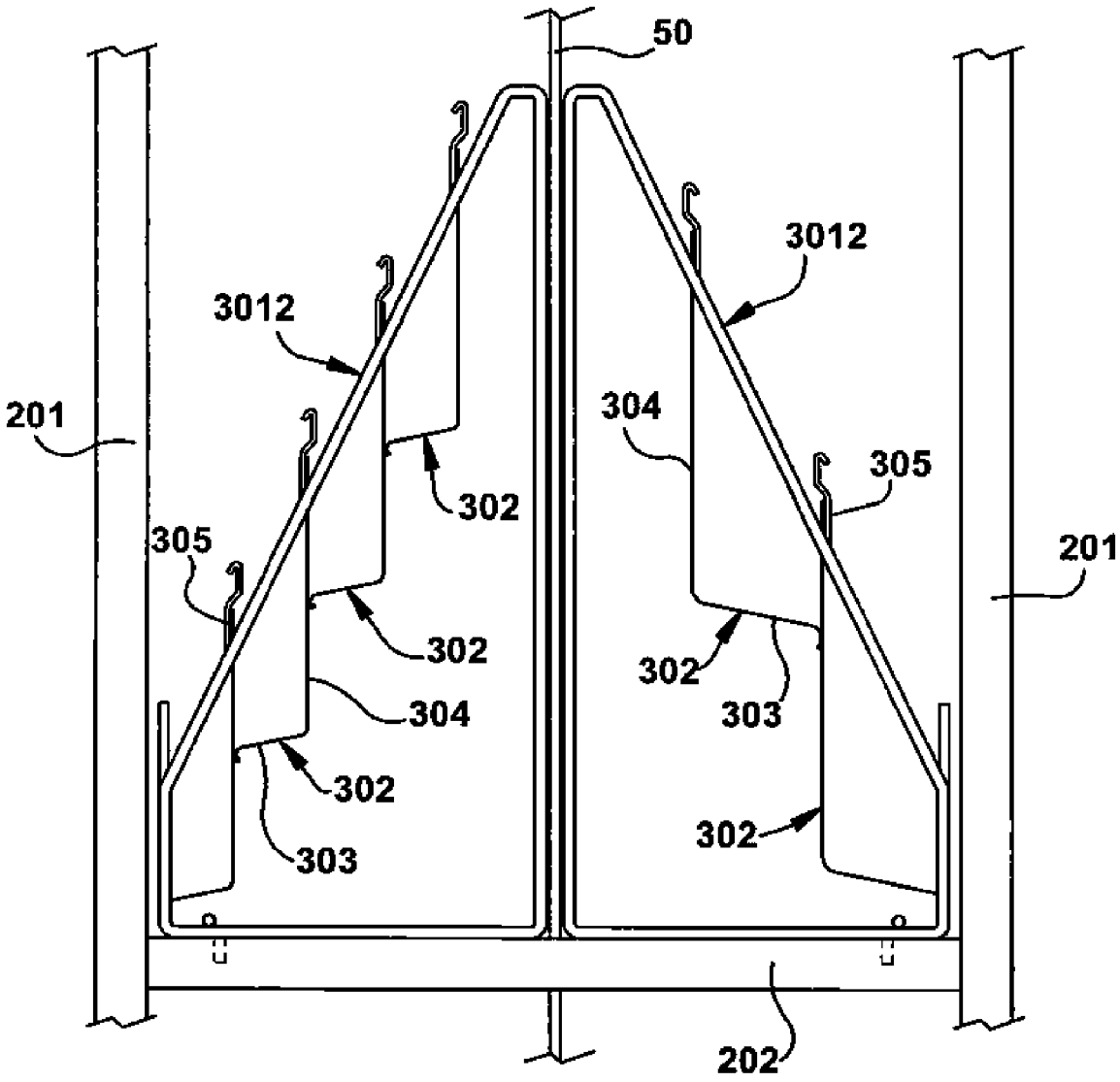
FIG. 5 is an elevation of a portion of a configurable retail display of the disclosure.

The display unit frames 301 may be generally A-shaped as frame 3011 shown in FIG. 3, to support opposing shelves 302 in an opposed arrangement, or tiers of shelves 302, or as right triangle frames 3012 as shown in FIG. 5 to support only one shelf 302 or one or more tiers of shelves 302 on one side of the display. Either type of frame 3011 or 3012 can be used to provide the same or different numbers of shelves 302 on opposing sides of the display, shown with the same number of shelves in FIGS. 2 and 3, and different numbers of shelves in FIG. 5. By use of the right triangle frames 3012 of FIG. 5, one side of the display can be changed with respect to the number of shelves 302 without changing the opposite side of the display. The display units 30 which are configured with the right triangle frames 3012 are also referred to herein as right triangle display units. This is one manner in which the display can be configured with respect to individual shelves or tiers of shelves without altering the entire display.

Figure 4:
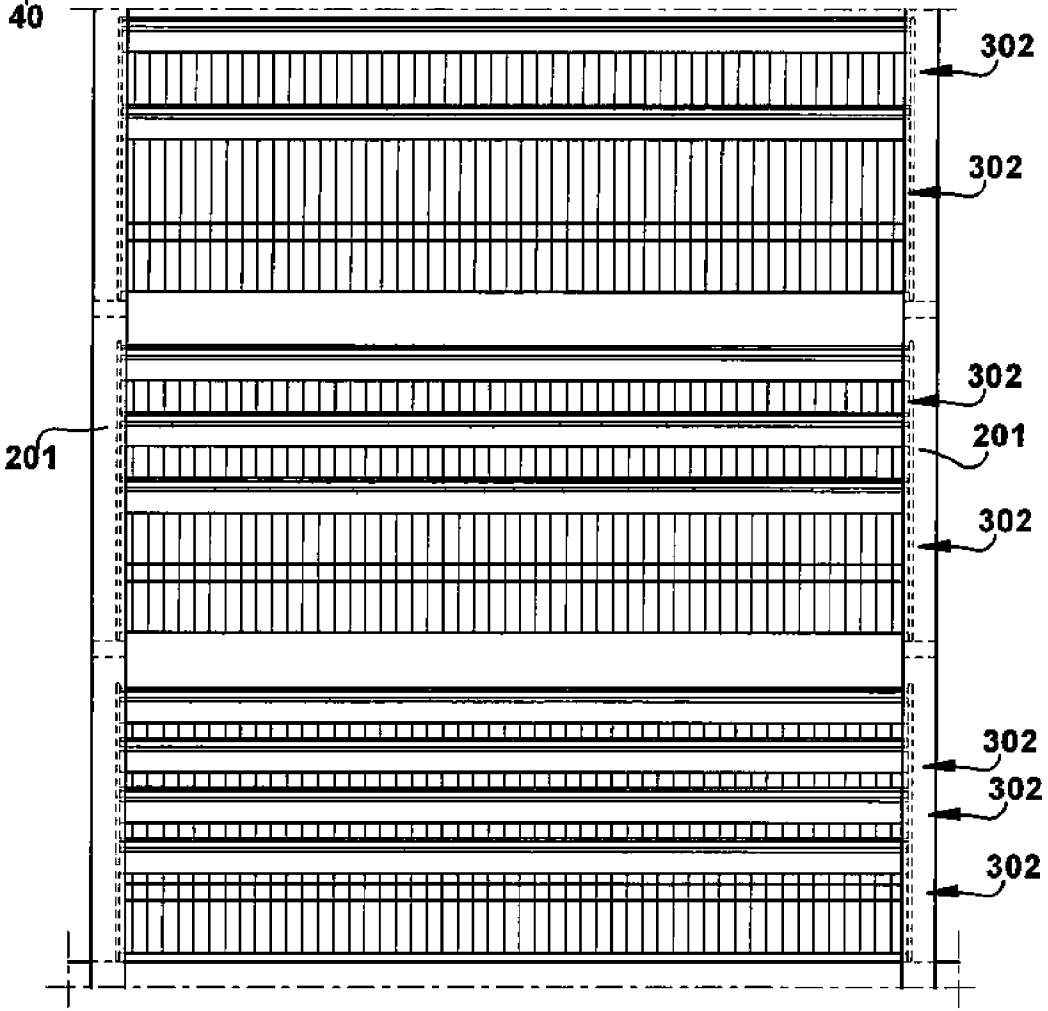
FIG. 4 is a partial elevation view of the configurable retail display shown in FIGS. 1 and 3.

The display 10 is also configurable with respect to the number of shelves on 302 associated with each pair of frames 3011 or 3012, as supported by each pair of cross beams 202. As shown in FIGS. 1, 3, 4 and 6, the number of shelves 302 per display unit 30 may vary among the different levels 203 of the display. As shown in FIGS. 3 and 4, a first level 2031 of the display may have a display unit 30 with four tiered shelves 302, a second level 2032 with a display unit 30 with three tiered shelves 302, and a third level 2033 with a display unit 30 with two tiered shelves 302. Any other numbers of shelves and display unit combinations are possible, either with symmetrical opposing sides using the A frames 3011 as shown in FIG. 3, or asymmetrically using the right angle frames 3012 as shown in FIG. 5. The frames 3012 provide a one-sided display unit 30, meaning that the shelves 302 attached to frames 3012 face only one side of the display 1. When supported by the same pair of cross beams 202, display units 30 with frames 3012 are in an opposed arrangement, as shown in FIG. 5. As further described, panels 50 can be positioned within the support frame and between the shelves of the display units 30.

The frames 3011 and 3012 are supported by the cross beams 202, by for example resting directly upon the cross beams 202 and located and fixed in place by pins 306 as shown in FIG. 2, or other suitable location or fastening hardware. As shown in FIG. 4, the alignment of the vertical members 201 with the respective cross beams 202 effectively conceals the frames 3011, 3012 from the front view of the display, while leaving exposed substantially all of the shelves 302 for optimal display of products supported by the shelves 302, and to create a neat appearance to the display 1 from the primary viewing perspective. In other words, the spacing of the frames 3011, 3012 of each display unit 30 is equal to the spacing of surfaces of one vertical member 201 to the surface of a next laterally disposed vertical member 201, so that a surface of each vertical member 201 effectively conceals the frames 3011, 3012 from the frontal appearance of the display fixture, while preferably leaving enough clearance for installation and removal of display units 30 to and from the support frame 20.

The display is also configured to receive and hold one or more panels 50 in a vertical orientation between the opposing shelves or tiers of shelves 302. The panel or panels 50 may extend from the base 10 to the top of or above the uppermost shelf 302, or to the very top of the vertical members 201 or beyond. The panels 50 may be made of any suitable material, transparent or opaque and bear color and/or graphics. The panels 50 provide backdrops for opposing shelves or tiers of shelves 302, fitting between opposing shelves 302 of the display units (whether with frames 3011 or 3012) and create a neat appearance to the display from each side by effectively concealing the back of the opposite side of the display. The background appearances or themes of the opposing sides of the display can be the same or different according to the color and content of the panels 50.

The invention claimed is:

1. A product display comprising:

a support frame having at least two spaced apart pairs of vertical members, each pair of vertical members connected by at least two cross beams located at different heights along the length of the vertical members;

at least two pair of spaced apart display unit frames, each display unit frame located between a pair of vertical members of the support frame and directly supported by one of the at least two cross beams of the support frame; and at least two display units extending between and directly supported by each of the at least two pair of spaced apart display unit frames, each display unit having at least two tiered shelves thereon;

wherein the display unit frames are in the form of A frames which support the at least two shelves in an opposed arrangement.

2. The product display of claim 1, wherein the display unit frames are configured to support two or more shelves on only one side of the support frame.

3. The product display of claim 1, wherein the display unit frames are aligned with the vertical members of the support frame.

4. The product display of claim 1, wherein the display unit frames are engaged with the cross beams of the support frame.

5. The product display of claim 1, wherein each of the at least two display units further includes a second display unit with symmetrical shelves on opposing sides of each of the at least two display units.

6. The product display of claim 1 further comprising an asymmetrical display unit with asymmetrical shelves located on opposing sides of each of the at least two display units.

7. The product display of claim 6, wherein each of the one or more display units has a different number of shelves on one side of the display unit than on an opposite side of the display unit.

8. The product display of claim 1, wherein the display unit frames extend substantially from the cross beam on which the display unit frame is located to a second cross beam located above the display unit frame.

9. The product display of claim 1 comprising multiple rows of display units, and wherein the display units of each row have the same number of shelves.

10. The product display of 1, wherein each display unit has a different number of shelves on each side of the display.

11. The product display of claim 1, wherein the at least two display units are one-sided display units.

12. The product display of claim 1, wherein each of the at least two display units are double-sided.

13. The product display of claim 1, wherein the at least two display units include at least one one-sided display unit and at least one double-sided display unit.

14. The product display of claim 1 comprising at least three display units, each of the at least three display units positioned at a different elevation upon the support frame, and each of the at least three display units having a different number of shelves from the other at least three display units.

15. The product display of claim 14, wherein the display unit located at the highest elevation upon the support frame has a fewer number of shelves than the display unit located at the lowest elevation upon the support frame.

16. The product display of claim 1 further comprising a panel which fits within the support frame in a vertical orientation and is positioned between shelves of a display unit.

17. The product display of claim 1 further comprising a panel which fits within the support frame in a vertical orientation and is positioned between opposing display units supported by the frame.

18. The product display of claim 1, wherein the support frame comprises at least three spaced apart pairs of vertical members.

19. The product display of claim 1 comprising multiple display units supported at multiple elevations on the support frame, wherein the multiple display units located at the same elevation have the same number of shelves, and wherein the multiple display units located at each elevation have a different number of shelves than the multiple display units located at other elevations.

20. A configurable display product having a base and a support frame on the base, the support frame having two pairs of spaced apart vertical members and one or more cross beams which extend between the pairs of vertical members;

one or more display units configured to fit between the pairs of vertical members and directly supported by the one or more cross beams of the two pairs of spaced apart vertical members at a common elevation, each display unit having a distinct pair of spaced apart frames and two or more shelves which extend between the frames, each shelf having a product supporting surface which is contiguous with a front wall and a rear wall which is spaced from the front wall, the product supporting surface of each shelf of each display unit being at a different elevation on the frame of the display unit, at least one of the display units having a different number of shelves in an opposed arrangement wherein the shelves face opposite sides of the product display;

wherein the one or more display units have a pair of spaced apart A-shaped frames with at least one shelf which extends between and is supported by the A-shaped frames and faces a first direction, and at least one shelf which extends between and is supported by the A-shaped frames and faces in a second direction opposite the first direction.

21. The configurable product display of claim 20, wherein one display unit faces a first direction and a second display unit faces a second direction opposite the first direction.

22. The configurable product display of claim 20 further comprising a panel positioned within the support frame in a vertical orientation and located between shelves of two or more display units.

23. The configurable product display of claim 22, wherein the panel extends from the base of the display to an uppermost display unit on the support frame.

24. The configurable product display of claim 20 having at least three pairs of cross beams, each pair of cross beams located at different elevations on the support frame, and vertically spaced to allow installation and removal of one or more display units between the at least three pairs of cross beams.

25. The configurable product display of claim 20, wherein the spaced apart frames of the display units are located between vertical members of the support frame.

26. The configurable product display of claim 20, wherein the at least one display unit is supported directly by the base and the spaced apart frames of the display unit are located between vertical members of the support frame wherein the spaced apart frames are generally aligned with the vertical members of the support frame.

* * * * *